US005622055A

United States Patent [19]

Mei et al.

[11] Patent Number: 5,622,055

[45] Date of Patent: Apr. 22, 1997

[54] LIQUID OVER-FEEDING REFRIGERATION SYSTEM AND METHOD WITH INTEGRATED ACCUMULATOR-EXPANDER-HEAT EXCHANGER

[75] Inventors: Viung C. Mei, Oak Ridge; Fang C. Chen, Knoxville, both of Tenn.

[73] Assignee: Martin Marietta Energy Systems, Inc., Oak Ridge, Tenn.

[21] Appl. No.: 408,248

[22] Filed: Mar. 22, 1995

[51] Int. Cl.[6] ..... F25B 41/06

[52] U.S. Cl. ..... 62/113; 62/503; 62/513

[58] Field of Search ..... 62/513, 511, 113, 62/503

[56] References Cited

U.S. PATENT DOCUMENTS

| | | | |
|---|---|---|---|
| 2,393,854 | 1/1946 | Carpenter | 62/511 |
| 2,472,729 | 6/1949 | Sidell | 62/513 X |
| 2,482,171 | 9/1949 | Gygax | 62/511 X |
| 3,283,524 | 11/1966 | Byron | 62/503 X |
| 3,621,673 | 11/1971 | Foust | 62/503 |
| 3,872,687 | 3/1975 | Bottum et al. | 62/243 |
| 3,955,375 | 5/1976 | Schumacher | 62/217 |
| 4,106,308 | 8/1978 | Miller | 62/511 X |
| 4,216,660 | 8/1980 | Rodgers | 62/238 |
| 4,217,765 | 8/1980 | Ecker | 62/503 |
| 4,304,099 | 12/1981 | Vakil | 62/86 |
| 4,488,413 | 12/1984 | Bottum | 62/503 |
| 4,646,527 | 3/1987 | Taylor | 62/85 |
| 5,245,833 | 9/1993 | Mei et al. | 62/113 |

*Primary Examiner*—Harry B. Tanner

*Attorney, Agent, or Firm*—Earl L. Larcher; Patrick D. Guettner

[57] ABSTRACT

A refrigeration system having a vapor compression cycle utilizing a liquid over-feeding operation with an integrated accumulator-expander-heat exchanger. Hot, high-pressure liquid refrigerant from the condenser passes through one or more lengths of capillary tubing substantially immersed in a pool liquid refrigerant in the accumulator-expander-heat exchanger for simultaneously sub-cooling and expanding the liquid refrigerant while vaporizing liquid refrigerant from the pool for the return thereof to the compressor as saturated vapor. The sub-cooling of the expanded liquid provides for the flow of liquid refrigerant into the evaporator for liquid over-feeding the evaporator and thereby increasing the efficiency of the evaporation cycle.

17 Claims, 2 Drawing Sheets

LIQUID OVER-FEEDING REFRIGERATION SYSTEM AND METHOD WITH INTEGRATED ACCUMULATOR-EXPANDER-HEAT EXCHANGER

BACKGROUND OF THE INVENTION

The present invention relates generally to refrigeration systems including air-conditioning systems utilizing a liquid over-feeding operation. More particularly, the present invention is directed to such refrigeration systems employing an accumulator-expander-heat exchanger containing capillary tubing through which hot, high-pressure liquid refrigerant from the condenser is passed in a heat exchange relationship with a pool of relatively cool liquid refrigerant in the accumulator-expander-heat exchanger for simultaneously expanding the liquid refrigerant and super sub-cooling the liquid refrigerant in the capillary tubing prior to the introduction of the super-cooled liquid refrigerant into the evaporator. This invention was made with the support of the United States Government under contract No. DE-AC05-84OR21400 awarded by the U.S. Department of Energy. The United States Government has certain rights in this invention.

Refrigeration systems including air-conditioning systems and heat pumps which utilize a vapor compression cycle normally include a refrigerant vapor compressor serially interconnected with a refrigerant vapor condenser, an expansion valve, and an evaporator. In many refrigeration or air-conditioning systems, particularly air-conditioning systems used in the automotive industry, expansion valves of various types including fixed orifices and heat sensitive automatic valves are incorporated in the piping or conduit system between the condenser and the evaporator for decreasing the pressure of the liquid refrigerant from the high pressure side of the system at the condenser to the low pressure side of the system at the evaporator by expanding the liquid refrigerant to substantially vapor. The utilization of such expansion valves not only represent a considerable cost factor of the refrigeration system but are often a source of problems in the operation of the air-conditioning system. Further, the utilization of such valves have been found to significantly reduce the efficiency of the refrigeration or air-conditioning system due to the cooling-effect losses at the expansion valve during the expansion of the liquid refrigerant to a substantially vaporous form.

A recent development in refrigeration air-conditioning systems is described in assignee's U.S. Pat. No. 5,245,833, which issued Sep. 21, 1993 and entitled "Liquid Over-Feeding Air-Conditioning System and Method", V. C. Mei et al. As described in this patent, the refrigeration system utilizes a compressor, condenser, expansion device, and an evaporator coupled together by suitable conduits and includes an accumulator-heat exchanger positioned to receive hot, high pressure condensed refrigerant from the condenser in indirect heat exchange with a relatively cool mixture of vaporous and liquid refrigerant and a pool of liquid refrigerant provided by the evaporator. In this accumulator-heat exchanger, the hot liquid refrigerant discharged from the condenser passes through a coil of conventionally sized tubing substantially immersed within the pool of relatively cool liquid refrigerant to provide a heat exchange relationship between the hot liquid refrigerant and the liquid refrigerant in the pool. This indirect heat exchange relationship between the hot, high-pressure refrigerant and the pool of relatively cool liquid refrigerant sub-cools the high pressure liquid refrigerant from the condenser to a temperature at least 20° lower than that of the liquid refrigerant initially discharged from the condenser. This sub-cooled liquid refrigerant undergoes little or no evaporation across the expansion device positioned downstream of the accumulator-heat exchanger to provide a liquid overfeeding operation through the evaporator. The suction line between the accumulator-heat exchanger and the compressor passes through the pool of liquid refrigerant to cool and substantially fully saturate the vaporous refrigerant being returned to the compressor. Inasmuch as the improved refrigeration system of the present invention utilizes a liquid over-feeding operation as described in the refrigeration system in assignee's aforementioned patent, this patent is specifically incorporated herein by reference.

Efforts to obviate the use of expansion valves or expansion devices in various refrigeration and air-conditioning systems, except for possibly the air-conditioning systems utilized in the automotive field and in relatively large capacity refrigeration systems, include the utilization of capillary tubing as the mechanism for expanding the liquid refrigerant from the high pressure side to the low pressure side of the system. For example, refrigeration systems as commonly used in refrigerators, freezers, room air-conditioners, and heat pumps employ capillary tubing as the liquid conveying mechanism between the condenser and the evaporator for effecting the desired expansion and pressure drop of the liquid refrigerant. However, while the utilization of such capillary tubing in refrigeration and air-conditioning systems has been found to reduce manufacturing and maintenance costs associated with the elimination of the expansion valves and their attendant problems, system requirements dictate that the capillary tubing must be of a significantly greater length than the conduits utilized with systems having expansion devices so as to provide the desired pressure drop from the high pressure side to the lower pressure side. Thus, the capillary tubing is often subjected to damage during the handling or repair of the refrigeration system. Normally, this capillary tubing is also exposed to the ambient conditions within the environs of the air-conditioning or refrigeration system so that little or no heat exchange occurs between the liquid refrigerant within the capillary tubing and the air environment surrounding the capillary tubing.

SUMMARY OF THE INVENTION

A primary aim or objective of the present invention is to provide an improved refrigeration or air-conditioning system employing a liquid over-feeding operation as in assignee's aforementioned patent by utilizing an integrated accumulator-expander-heat exchanger with a coil of capillary tubing contained therein so as to provide a significant improvement in heat transfer between the hot liquid refrigerant from the condenser and the pool of relatively cool liquid refrigerant in the accumulator-expander-heat exchanger to produce a level of system efficiency considerably higher than previously attainable. In the present invention an integrated accumulator-expander-heat exchanger and coiled capillary tubing arrangement is used in place of the accumulator-heat exchanger, coiled tubing, and expansion device used in the assignee's patented system. In accordance with the present invention the coil of capillary tubing is immersed within a pool of relatively cool liquid refrigerant so as to simultaneously sub-cool the hot refrigerant to a temperature of at least 25° F. lower than the temperature of the hot liquid refrigerant discharged from the condenser, effect expansion of the hot liquid refrigerant as it is sub-cooled while maintaining the refrigerant in essentially liquid form for the introduction thereof into the evaporator, and effect super saturation of any vaporous refrigerant generated in the evaporator or in the accumulator-expander-heat exchanger for return to the compressor.

The improved refrigeration system of the present invention is for use in refrigerators, freezers, room air-conditioners, and heat pumps, as well as in air-conditioning system applications utilized in the automotive industry and comprises: compressor means for compressing a vaporous refrigerant to an elevated pressure and temperature substantially greater than ambient pressure and temperature; condensing means for condensing the compressed vaporous refrigerant to liquid refrigerant at substantially said elevated pressure and temperature; evaporator means for substantially evaporating the condensed liquid refrigerant; first conduit means connecting the compressor means to the condensing means; second conduit means connecting the condensing means to the evaporator means; third conduit means connecting the evaporator means to the compressor means; and housing means having a cavity therein containing a first portion of the second conduit means and a portion of third conduit means. The portion of the third conduit means comprises first and second open-ended sections with the first section being adapted to receive and convey a mixture of liquid and vaporous refrigerant from the evaporator means into the cavity of the housing for forming and replenishing a pool of liquid refrigerant therein and with the second section being adapted to receive and convey vaporous refrigerant from the cavity of the housing to the compressor means. The first portion of the second conduit means comprises elongated capillary tubing means adapted to receive and convey therethrough the condensed liquid refrigerant from the condensing means for the expansion thereof to a pressure substantially lower than the elevated pressure of the condensed liquid refrigerant at the condensing means. The elongated capillary tubing means are substantially disposed in a heat exchange relationship with liquid refrigerant in the pool of liquid refrigerant for cooling the condensed liquid refrigerant to a temperature substantially less than the elevated temperature of the condensed liquid refrigerant at the condensing means and for converting liquid refrigerant in the pool to vaporous refrigerant for reception by the second section of the third conduit means for the conveyance thereof along with vaporous refrigerant from the mixture of vaporous and liquid refrigerant to the compressor means.

The elongated capillary tubing means is defined by at least one capillary tube which has an internal diameter sufficiently small and is of a length sufficiently long to effect sufficient expansion of the liquid refrigerant to the lower pressure for reception thereof in essentially liquid form in the evaporator means.

In preferred embodiments of the present invention, the at least one capillary tube defining the elongated capillary tubing means has an internal diameter in the range of about 0.025 to 0.09 inch in diameter and is of a length in the range of about 1 to 12 feet. Also, substantially the full length of the at least one capillary tube defining the elongated capillary tubing means is substantially in the form of a coil containable in the pool of liquid refrigerant.

The at least one capillary tube defining the elongated capillary tubing means is provided by a single capillary tube or a plurality of capillary tubes each having first and second end regions. With the plurality of capillary tubes, first manifold means connect the first end region of each of the plurality of capillary tubes to a second portion of the second conduit means and second manifold means connect the second end region of each of the plurality of capillary tubes to a third portion of the second conduit means.

The method for operating the refrigeration system of the present invention is provided by the steps comprising: forming a portion of the second conduit means from capillary tube means; passing compressed refrigerant vapor at a pressure and temperature substantially greater than ambient pressure and temperature from the compressing means into the condensing means for the condensation thereof into liquid refrigerant at a pressure and temperature substantially greater than ambient; passing liquid refrigerant discharged from the condensing means through the capillary tube means disposed in a heat exchange relationship with a mixture of liquid and vaporous refrigerant discharged from the evaporating means and a pool of liquid refrigerant formed by liquid refrigerant in this mixture for vaporizing liquid refrigerant in this mixture and in the pool for simultaneously and sufficiently sub-cooling and expanding the liquid refrigerant in the capillary tube means to provide for the introduction of the expanded and sub-cooled liquid refrigerant into the evaporating means with substantially no additional expansion or evaporation thereof for over feeding of the evaporating means with liquid refrigerant to effect contact of essentially all of the cooling regions therein with liquid refrigerant and to provide the mixture of liquid and vaporous refrigerant discharged from the evaporating means; and, thereafter conveying vaporous refrigerant from the mixture and from the vaporization of the liquid refrigerant in the mixture and in the pool to the refrigerant compressing means for the compression thereof.

The sub-cooling of the liquid refrigerant is sufficient to provide the sub-cooled liquid refrigerant with a temperature that is at least about 25° F. lower than the temperature of the liquid refrigerant discharged from the condensing means. Preferably, when the temperature of the liquid refrigerant discharged from the condensing means is in the range of about 20° to 30° F. above ambient temperature, the temperature of the sub-cooled liquid refrigerant of the aforementioned at least 25° F. lower than the temperature of the liquid refrigerant discharged from the condensing means is at a temperature in the range of 25° F. to about 40° F.

Other and further objects of the present invention will become obvious upon an understanding of the illustrative embodiments about to be described or will be indicated in the appended claims, and various advantages not referred to herein will occur to one skilled in the art upon employment of the invention in practice.

Figure 1:
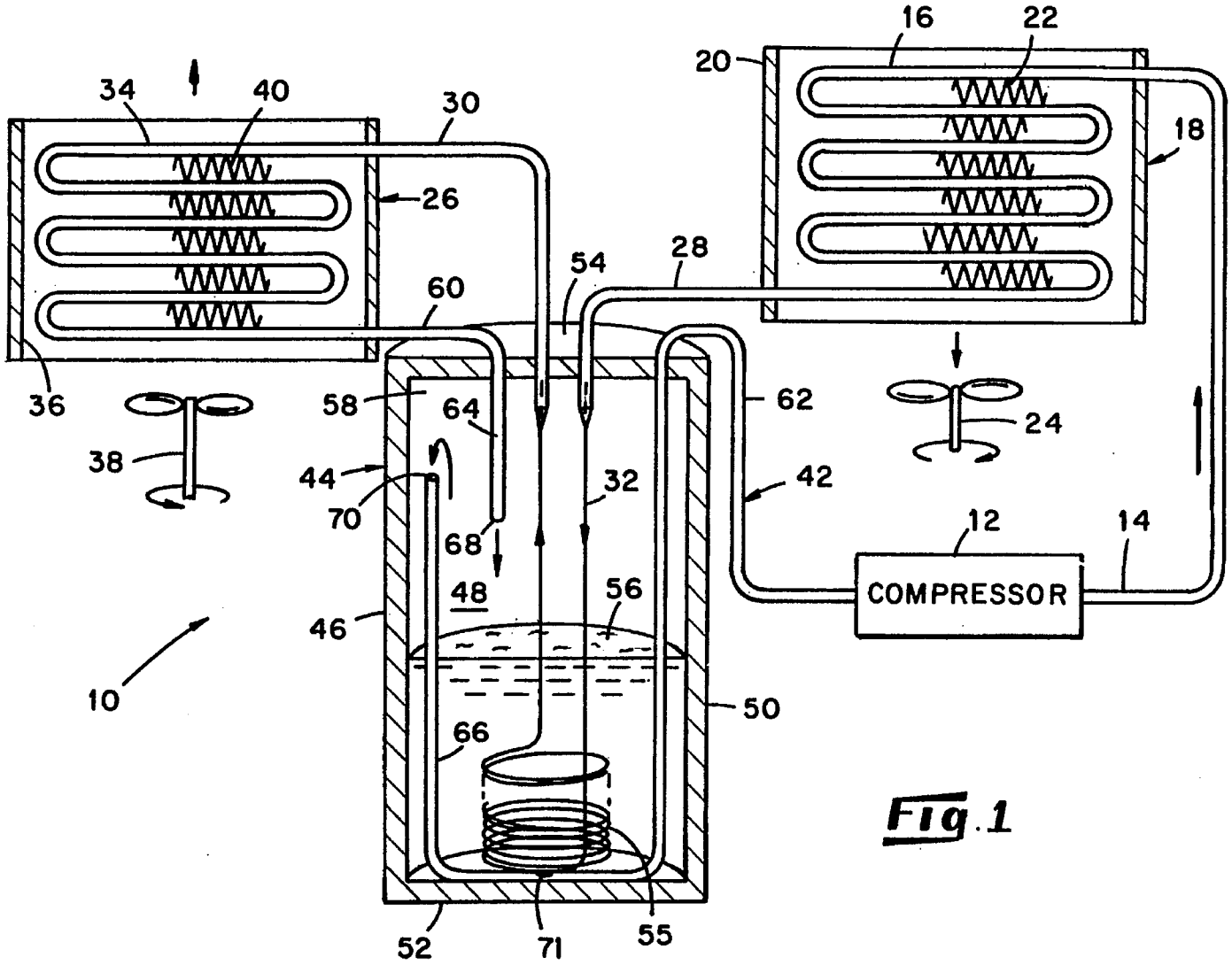
FIG. 1 is a schematic flow diagram of an embodiment of the refrigeration system of the present invention in which an integrated accumulator-expander-heat exchanger assembly is incorporated in the liquid refrigerant line between the condenser and the evaporator and in the suction line of the compressor for effecting the improved liquid over-feeding and heat exchange operation achieved by the present invention.

Preferred embodiments of the invention have been chosen for the purpose of illustration and description. The preferred embodiments illustrated are not intended to be exhaustive nor to limit the invention to the precise forms shown. The preferred embodiments are chosen and described in order to best explain the principles of the invention and their application and practical use to thereby enable others skilled in the art to best utilize the invention in various embodiments and modifications as are best adapted to the particular use contemplated.

DETAILED DESCRIPTION OF THE INVENTION

The liquid over-feeding refrigeration system of the present invention generally comprises a conventional refrigerant compressor, a condenser and evaporator which are operatively coupled together by a conduit arrangement which includes a length of capillary tubing disposed between the condenser and the evaporator and housed within an integral accumulator-expander-heat exchanger assembly. A suitable refrigerant as commonly used in refrigeration vapor compression cycles is circulated in liquid and vaporous form with the vaporous refrigerant being compressed to a high temperature and high pressure gas that is serially condensed in the condenser to a high temperature and high pressure liquid, subjected to a pressure drop in the capillary tubing, and thereafter substantially converted to vapor in the evaporator to provide the desired cooling effect. In the liquid over-feeding refrigeration system of the present invention a significantly higher level of heat transfer is achieved in the integrated accumulator-expander-heat exchanger than attainable in the accumulator-heat exchanger in assignee's aforementioned patent. The required pressure drop from the high side to the low side of the system is achieved in the capillary tubing rather than in a direct expansion device as in assignee's aforementioned patent, with liquid over-feeding being provided to the evaporator for permitting 100% use of the evaporator coils for cooling purposes since any liquid along with the vaporous refrigerant discharge from the evaporator is received in the accumulator-expander-heat exchanger for sub-cooling the refrigerant passing through the capillary tubing.

The refrigeration system of the present invention can utilize essentially any commercially available refrigerant including refrigerants such as those known as R-12, R-22, R-134a, azeotropic refrigerants such as R-500, and nonazeotropic refrigerant mixtures of R-32 and R-22, with refrigerants R-134 and R-152a. The particular refrigerant or combination of refrigerants utilized in the present invention is not deemed to be critical to the operation of the present invention since the present invention is expected to operate with a greater system efficiency than achievable in any previously known air-conditioning system utilizing the same refrigerant.

In accordance with the present invention, the refrigeration system using the refrigerant chlorodifluoromethane (R-22) in air conditioning applications is expected to utilize suction line pressures in the range of about 50 to 100 psia, compressor discharge pressures in the range of about 180 to 350 psia, condenser discharge pressures of about 10 psi or less, and evaporator inlet pressures in the range of about 60 to 100 psia. Also, refrigerant temperatures in the range of 40° F. to 60° F. at the compressor inlet, 150° F. to 250° F. at the compressor discharge, and 40° F. to 60° F. at the evaporator inlet, are operational temperatures expected to be useable in the present invention.

Described more specifically and with reference to FIG. 1, the present over-feeding refrigeration system 10 utilizing the integrated accumulator-expander-heat exchanger is shown comprising a compressor 12 of any suitable, commercially available type capable of compressing a vaporous refrigerant such as described above to an appropriately high pressure and temperature with the particular pressure and temperature of this compressed refrigerant being dependent upon system requirements, the type of refrigerant used, and the ambient operating conditions. Also, in the present invention the pressures and temperatures of the vaporous refrigerant on the high side of the compressor are pressures and temperatures well known to those skilled in the art of utilizing vapor compression refrigeration cycles.

The compressed vaporous refrigerant discharged from the compressor 12 is conveyed through conduit 14 into a coiled conduit arrangement 16 in condenser 18 where the vaporous refrigerant is condensed to a high temperature liquid at a pressure substantially the same as that provided at the compressor discharge. The coiled conduit section 16 of the condenser is shown supported in a conventional condenser housing 20 and is shown provided with appropriate cooling fins 22 positioned about the coil conduit section 16 for facilitating the condensation of the vaporous refrigerant when a fluid heat exchange medium such as water or air, such as supplied by fan 24, is passed through the condenser housing 20 in a heat exchange relationship with the coiled conduit section 16.

In the present invention the condenser 18 is coupled to an evaporator 26 by a conduit-capillary tubing assembly shown comprising conduit sections 28 and 30 respectively coupled at one end thereof to the condenser 18 and to the evaporator, and at the other end thereof to an intermediate capillary tubing section 32. The conduits sections 28 and 30 as well as the other conduits used in the refrigeration system, except for the capillary tubing 32, have an internal diameter in the range of about 0.25 to 0.50 inch, normally about 0.25 to 0.375 inch, which is common for refrigeration systems utilizing vapor compression cycles such as used in refrigerators, freezers, heat pumps, and the like where capillary tubing is used as the mechanism for expanding the liquid refrigerant from the high pressure side to the low pressure side or in an automotive air-conditioning system where expansion devices are used for expansion of liquid refrigerant. The capillary tubing 32, on the other hand, has an internal diameter in the range of about 0.03125 to about 0.0625 inch, preferably about 0.046875 inch (3/64th inch) and is of a length sufficient to effectively decrease the pressure of the liquid refrigerant from a pressure at the condenser discharge in the range of about 150 to 250 psi to a pressure at the evaporator in the range of about 50 to 100 psi. Usually for each foot of capillary tubing with an internal diameter of about 0.046875 inch, a pressure drop of about 5 to 30 psi is achieved.

The liquid refrigerant at the low pressure side of the system as provided by the capillary tubing 32 is conveyed into the evaporator 26 where evaporation of a substantial portion of the liquid refrigerant occurs while passing through conduit coils 34 and absorbing heat from a heat exchange medium such as water or air surrounding the coil as in a water cooler or air conveyed through the evaporator housing 36 by a fan such as shown at 38. Suitable heat exchange fins 40 may be disposed about the conduit coils 34 to facilitate heat transfer between the heat exchange medium and the refrigerant in the conduit coils 34. The heat exchange medium is cooled to a temperature of about 0° to 8° F. for use in refrigerators and freezers and to a temperature range of about 35° to 45° F. for use in a conventional heat pump or air-conditioning system. The evaporator 26 is coupled to the compressor 12 by a sectioned or broken suction line assembly 42 whereby vaporous refrigerant is returned to the compressor 12 and recompressed for reuse in the refrigeration cycle.

As in the liquid over-feeding system described in assignee's aforementioned patent, hot, high-pressure liquid refrigerant discharged from the condenser 18 is passed in an indirect heat exchange relationship with a relatively cool mixture of liquid and vaporous refrigerant discharged from the evaporator 26 through a first segment of the suction line assembly 42 for effectively sub-cooling the liquid refrigerant discharged from the condenser 18 while simultaneously vaporizing liquid refrigerant in the liquid-vaporous refrigerant mixture discharged from the evaporator 26. In the present invention this heat exchange relationship between the hot, condensed liquid refrigerant and the relatively cool liquid-vaporous refrigerant mixture is achieved by employing an accumulator-expander-heat exchanger assembly 44 in which the capillary tubing 32 is contained to inhibit the damage to the capillary tubing and, more importantly, to effect a highly efficient exchange of heat from the hot, condensed liquid refrigerant to the relatively cool liquid-vaporous mixture discharged from the evaporator 26 while simultaneously effecting the desired pressure drop in the condensed liquid from the high pressure side to the low pressure side of the refrigeration system. As shown, the accumulator-expander-heat exchanger assembly 44 comprises a closed, vertically oriented housing or vessel 46 of an elongated cylindrical configuration but can be of any suitable shape. The vessel 46 has an internal closed cavity 48 defined by the cylindrical side walls 50, a base or bottom wall 52, and a top end wall 54. The cavity 48 within the vessel 46 is of a volume adequate for containing the full length of the capillary tubing 32, primarily in the form of a coil 55, while retaining a sufficient amount of liquid refrigerant in the form of a pool 56 as provided by and replenished from the mixture of vaporous and liquid refrigerant discharged from the evaporator 26 for super sub-cooling the hot condensed liquid refrigerant discharged from the condenser 18 to a significantly low temperature. The volume of the cavity 48 is also sufficiently large so that a freeboard region 58 is established above the pool 56 of the liquid refrigerant for receiving the liquid-vaporous refrigerant from the evaporator 26 and vaporous refrigerant produced during the heat exchange with the hot, condensed liquid refrigerant passing through the capillary tubing 32.

Figure 2:
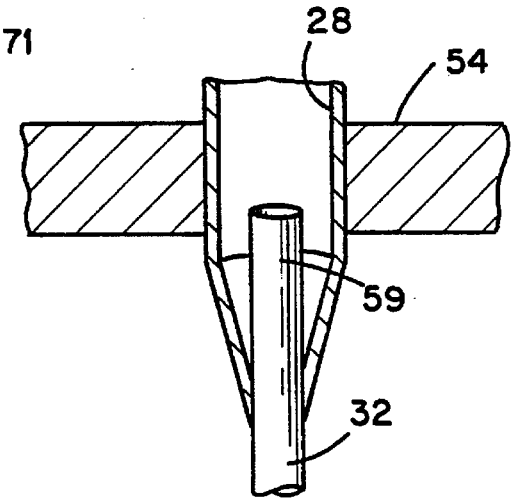
FIG. 2 is a fragmentary view of the FIG. 1 embodiment illustrating the coupling of the capillary tubing contained in the accumulator-expander-heat exchanger assembly to conduits of a larger diameter as used for conveying liquid and vaporous refrigerant through other parts of the system.

As shown in FIGS. 1 and 2, the capillary tubing 32 is entirely contained within the cavity 48 of the vessel 46 to protect the capillary tubing 32 from any damage during handling or repair of the system as well as to provide for the super sub-cooling of the liquid refrigerant passing through the capillary tubing 32 during the pressure drop or expansion of the liquid refrigerant, all essentially without the formation of vaporous refrigerant. The end regions of the conduit sections 28 and 30 are shown extending into the freeboard region 58 of the cavity 48 through suitable, sealable openings in the top end wall 54 of the vessel 46 and are joined in a fluid-tight manner to the open ends of the capillary tubing 32. As shown in FIG. 2, this joining of the open ends of the conduit sections 28 and 30 to the open ends of the capillary tubing 32 can be readily achieved by extending an end region 59 of the capillary tubing 32 into the open end of the conduit section 28 (or 30) and adequately swaging the end region of the conduit section 28 (or 30) onto the surface of the capillary tubing 32 to provide a fluid-tight seal as is well known in the art. Of course, if desired such a connection between the capillary tubing 32 and the conduit sections 28 and 30 can readily achieved by using conventional soldering, brazing, or any other well known joining technique.

The broken conduit assembly 42 connecting the evaporator 26 to the compressor 12 is formed of two conduits sections 60 and 62 which are respectively connected at one end thereof to the evaporator 26 and the compressor 12 with opposite open-end regions 64 and 66 of the conduit sections shown extending into the cavity 48 of the vessel 46 of the accumulator-expander-heat exchanger 44 through the top end wall 54 of the vessel. These conduits sections 60 and 62 are of a size which normally correspond to the size of the conduits 28 and 30. Refrigerant in vaporous and liquid form discharged from the evaporator 26 passes into the freeboard region 58 of the vessel 46 through the open end 68 of the end region 64 of conduit section 60 with this open end being located within the cavity 48 at a location above the pool 56 of liquid refrigerant to form and replenish the liquid refrigerant in the pool 56. The end region 66 of conduit section 62 is shown to have a generally U-shaped configuration with a substantial portion thereof being immersed within the pool 56 of the liquid refrigerant and with the open end 70 of this end region 66 of conduit 62 being positioned in the freeboard region 58 of the cavity 48 at a location above the open end 68 of the conduit section 64 to assure that only vaporous refrigerant in the freeboard region 58 enters the conduit section 62 coupled to the compressor 12. Also, by so positioning the end region 66 of the conduit section 62 in the vessel 46, the vaporous refrigerant entering the end region 66 of the conduit section 62 passes in a heat exchange relationship with the cooler liquid refrigerant in the pool 56 so as to assure that the vaporous refrigerant conveyed into the compressor 12 is saturated vapor and not as superheated vapor, which is undesirable because of reduced gas density and increased gas temperature.

With the aforementioned arrangement of the accumulator-expander-heat exchanger 44 in the present system, the hot, high pressure liquid discharged from the condenser is passed through the capillary tubing 32 in an indirect heat exchange relationship with the relatively cool liquid refrigerant in the pool 56 and with the warmer yet relatively cooler refrigerant vapor in the freeboard region 58 of the vessel 46. As shown, the capillary tubing 32, except for the relatively short opposite end regions thereof coupled to the conduit sections 28 and 30, is disposed in the pool 56 of liquid refrigerant. The resulting heat exchange relationship between the condensed liquid refrigerant in the capillary tubing 32 and the pool of liquid refrigerant sub-cools the hot, high pressure condensed liquid refrigerant from a condenser discharge temperature in the range of about 110° to 120° F., and normally about 20° to 30° F. higher than ambient air temperature, to a temperature in the range of about 70° F. to about 95° F. This extent of super sub-cooling of the liquid refrigerant is significantly greater than that achievable in previous systems utilizing expansion devices, suction line heat exchanger and the like as previously known. Also, this significant decrease in temperature of the liquid refrigerant from the condenser is more efficiently achieved and greater than that achievable in the system described in assignee's aforementioned patent due to the significantly greater surface area provided by the capillary tubing than that provided by the shorter and larger diameter tubing used in the accumulator-heat exchanger in assignee's aforementioned patent.

As with the arrangement described in assignee's aforementioned patent, the present invention overcomes cooling losses in the refrigeration system due to the evaporation of a substantial amount (about 20 to 25%) of the liquid refrigerant in commonly used expansion valves. The super-cooled low pressure liquid refrigerant flows through the coiled conduit 34 forming the evaporator 26 with a substantial portion of the liquid refrigerant being evaporated through 100% of the coil area in the evaporator 26 to provide the desired cooling effect. About 85 to 95% of the liquid refrigerant is evaporated in the evaporator 26 with the balance forming the mixture of a relatively cool and vaporous liquid refrigerant that is conveyed from evaporator 26 through conduit section 60 into the cavity 48 of the accumulator-expander-heat exchanger 44. This mixture of liquid and vaporous refrigerant is normally at a temperature in the range of about 40° to 60° F. for air conditioning applications and is effective to provide for the aforementioned super sub-cooling of the high-pressure condensed liquid refrigerant and the supersaturation of the vaporous refrigerant being returned to the compressor 12.

In refrigeration systems such as used in conventional systems refrigerator, freezers, window air-conditioners, and heat pump of relatively low capacity, a single capillary tubing such as shown at 32 in FIGS. 1 and 2 can usually convey and expand a sufficient volume of the liquid refrigerant to provide the desired amount of cooling effect. However, for refrigeration systems of larger capacity such as those used in commercial size refrigerators, freezers, high-capacity heat pumps, central air-conditioners and automotive air-conditioners, the amount of liquid refrigerant that is passed through a single capillary tubing is usually insufficient to provide the amount of refrigerant necessary for required cooling effect (or heating effect as in the case of a heat pump).

Lubricating oil as conventionally used in air conditioning and refrigeration systems for the lubrication of the compressor can be readily used in the present invention by employing a small opening 71 (usually of a diameter of about 0.04 centimeter) in the bight region of the conduit section 62 contained in the accumulator-expander-heat exchanger 44. Inasmuch as the lubricating oil will not vaporize along with the refrigerant in the accumulator-expander-heat exchanger 44 the lubricating oil will tend to accumulate in the bottom of the cavity 48 in the accumulator-expander-heat exchanger 44 and be drawn into the conduit section 62 through the opening 71 for lubricating the compressor 12. Little or no liquid refrigerant will pass along with the lubricating oil through this opening 71.

Figure 3:
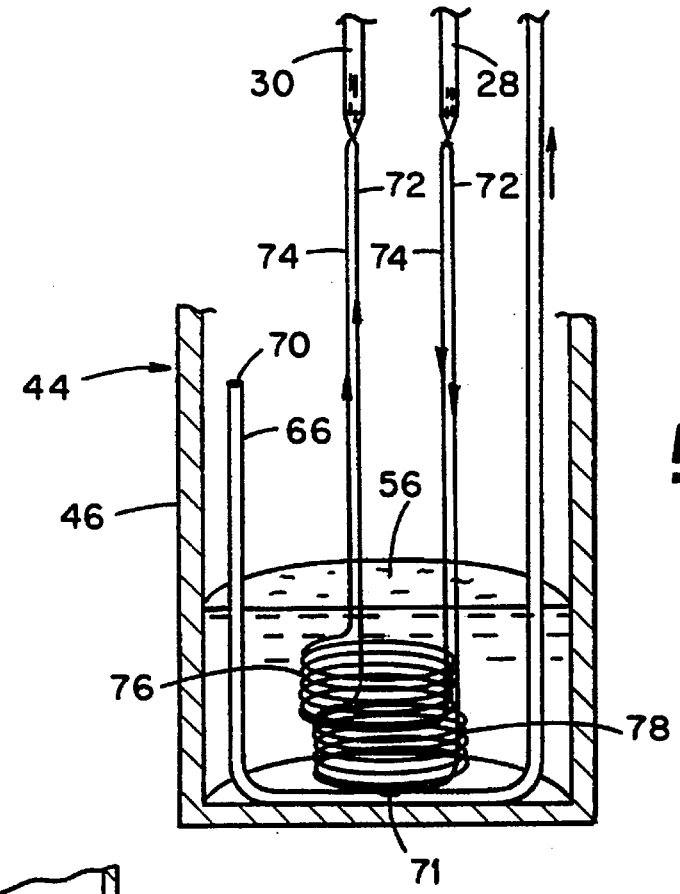
FIG. 3 is a fragmentary view of another embodiment of the accumulator-expander-heat exchanger assembly in which two capillary tubing sections are incorporated for providing increased flow of liquid refrigerant through the system.
Figure 4:
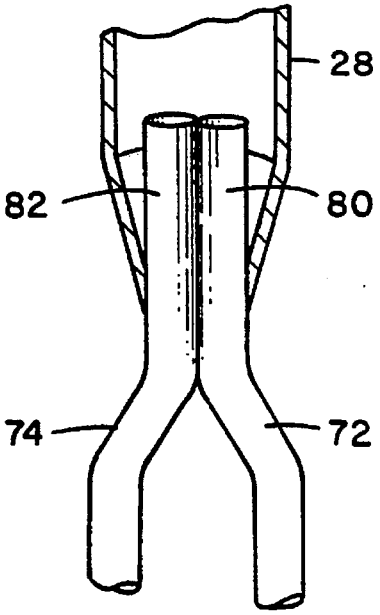
FIG. 4 is a fragmentary view of the FIG. 3 embodiment showing the coupling of two capillary tubing segments to a larger diameter conduit.

In accordance with the present invention as illustrated in FIGS. 3 and 4, two capillary tubing sections 72 and 74 are shown disposed in the cavity 48 of the accumulator-expander-heat exchanger 44 in place of the single capillary tubing 32 with the coiled segments 76 and 78 of the capillary tubing sections 72 and 74 being immersed in the pool 56 of the liquid refrigerant. The opposite ends of each of these capillary tubing sections 72 and 74 are connected to the conduit sections 28 and 30 in any suitable manner such as shown in FIG. 4 where the end regions 80 and 82 of each capillary tubing section 72 and 74 is inserted into the open end of conduit section 28 (or 30) and then the end region of conduit section 28 (or 30) is swaged to seal the conduit about the end regions 80 and 82 of the capillary tubing. However, as pointed out above, the connection of the capillary tubing sections 72 and 74 to the conduit sections 28 and 30 can be provided by employing any suitable joining technique such as by soldering, brazing, or the like. Also, while only two capillary tubing sections are shown in FIGS. 3 and 4 as being contained in the accumulator-expander-heat exchanger 44, it will appear clear that additional capillary tubing sections can be incorporated in the accumulator-expander-heat exchanger 44 in order to meet the refrigerant volume demand as required of the particular refrigeration system. With more than one capillary tube, and particularly when using as many as about 4 capillary tubes, the ends of the conduit sections can be flared or provided with enlarged segments so as to assure that tubing sections 28 and 30 are manifolded to the multiple capillary tubes.

The liquid over-feeding refrigerator system of the present invention provides a significant improvement over refrigeration systems using vaporous compression cycle known prior to the over-feeding refrigeration systems described in assignee's aforementioned patent and also provides substantial and unexpected increase in overall heat transfer coefficient over that achievable in the refrigerator system described in assignee's aforementioned patent. A comparative analysis of the heat transfer efficiency of the liquid over-feeding refrigeration system of the present invention (system A) with the liquid over-feeding air conditioning system described in assignee's aforementioned patent (system B) is set forth in the Table below. In this analysis, the operational capacities typical of a 2-ton air conditioner are utilized. The compressor discharge and suction pressures and the refrigerant pressures of approximately 185 psia and 81 psia before and after expansion are used in this analysis for both systems "A" and "B". Also, the temperature of 40° F. at the compressor inlet, and approximately 168° F. at the compressor discharge, are common to both system "A" and "B" while the temperatures of the refrigerant before expansion in system "A" is 120° F. as compared to about 100° F. in system "B". The refrigerant employed in this analysis is chlorodifluoromethane (R-22). The heat exchange coil used in the accumulator-heat exchanger in system "B" for this analysis is provided by a conventionally sized tube having an outer diameter of 0.375 inch, an inside diameter of 0.3125 and a calculated length of 10.6 inches. The measured volumetric flow rate for this tube is 0.67 gpm with a calculated mass flow rate of 400 lb/hr and with a calculated refrigerant velocity (V) of 10091 ft/hr provided by dividing the volumetric flow rate by the area of the tube ($(5/16)^2 \times \pi/4 \times 1/144$). With respect to system "A", four capillary tubes each having an outside diameter of 0.083 inch and an inside diameter of 0.046875 inch were used to provide a volumetric flow rate and mass flow rate required for operating a 2-ton air conditioner and for providing flow rates corresponding to system "B". The calculation of the refrigerant velocity for the capillary tubing requires the area in the calculation to be determined by the formula: $4((0.046875)^2 \times \pi/4 \times 1/144)$. The calculated Nusselt No. (Nu) as described in the publication "Convective Heat & Mass Transfer" edited by W. Kays (1966) is provided by the formula: $Nu=0.0155\ Pr^{0.5}\ Re^{0.83}$. The heat transfer or pool boiling ($h_{boiling}$) outside the tube (conventional and capillary tubes) was derived from the publication "ASHRAE Fundamental Handbook Two-Phase Flow", edited by ASHRAE, 1993. The overall heat transfer coefficient ($h_{overall}$) was calculated by using the formula:

$$\frac{1}{1/h_{conv} + 1/h_{boiling}}$$

TABLE

| Heat Transfer Coefficient Analysis | | |
|---|---|---|
| ANALYSIS | System "B" LIQUID OVER-FEEDING SYSTEM WITH EXPANSION DEVICE | System "A" LIQUID OVER-FEEDING SYSTEM WITH INTEGRATED CAPILLARY TUBING |
| Reynolds No. $Re = \rho VD/\mu =$ | 42533 | 67800 |
| Prandtl No. $Pr = Cp\mu/K =$ | 2.845 | 2.8001 |
| Nusselt No. $Nu = 0.0155\ Pr^{0.5}\ Re^{0.83} =$ | 181.63 | 265.4 |
| Convective heat transfer coefficient inside tube $h_{conv} = NuK/D =$ | 344 Btu/hr-f-f$^2$ | 3496 Btu/hr-f-f$^2$ |
| Heat transfer by pool boiling outside tube $h_{boiling} =$ | 550 Btu/hr-f-f$^2$ | 550 Btu/hr-f-f$^2$ |
| Overall heat transfer coef. $h_{overall} =$ | 212 Btu/hr-f-f$^2$ | 475 Btu/hr-f-f$^2$ |

From the calculations in the above Table, the unexpected significant increase (more than double) in the overall heat transfer coefficient provided by using the capillary tubing in the integrated accumulator-expander-heat exchanger (System "A") over that provided by the conventionally sized tubing in the accumulator-heat exchanger with expansion device (System "B") provides for the operation of refrigeration systems including air conditioners with a higher level of efficiency than previously obtainable. For example, with the higher overall heat transfer coefficient, expanded refrigerant at the evaporator will be super sub-cooled to a temperature of at least about 25° F. less than the temperature of the hot liquid refrigerant discharged from the condenser. This significant super sub-cooling of the hot liquid refrigerant passing through the capillary tubing contained in the accumulator-expander-heat exchanger is substantially greater than the sub-cooling of the liquid refrigerant obtainable by using the air conditioning system described in assignee's aforementioned patent. With the extent of sub-cooling of the hot refrigerant liquid at the evaporator without any change of phase as achieved by the present invention, the evaporator is provided with a stream of relatively cool liquid refrigerant so that the vaporization thereof in the evaporator not only allows for the use of all the evaporating regions in the evaporator but also provides a substantial increase in the overall cooling efficiency of the system as compared to the overall cooling efficiencies obtained with previous air-conditioning systems including the system described in assignee's aforementioned patent.

It will be seen that the liquid over-feeding refrigeration system or air-conditioning system of the present invention provides significant operational improvements over known refrigeration and air-conditioning systems utilizing vapor compression cycles whereby the use of less efficient but environmentally safer refrigerants can be employed without adversely affecting the refrigeration capacity.

What is claimed is:

1. A refrigeration system comprising compressor means for compressing a vaporous refrigerant to an elevated pressure and an elevated temperature greater than ambient pressure and temperature, condensing means for condensing the compressed vaporous refrigerant to liquid refrigerant at substantially said elevated pressure and temperature, means for expanding the condensed liquid refrigerant to a substantially lower pressure than said elevated pressure, evaporator means for receiving and evaporating a major portion of the condensed liquid refrigerant after the expansion thereof to said substantially lower pressure, first conduit means connecting the compressor means to the condensing means, second conduit means connecting the condensing means to the evaporator means, third conduit means connecting the evaporator means to the compressor means, and housing means having a cavity therein containing a first portion of said second conduit means and a portion of said third conduit means and adapted to contain a pool of liquid refrigerant at a temperature lower than said substantially lower temperature, said portion of the third conduit means comprising first and second open-ended sections with said first section being adapted to receive and convey a mixture of liquid and vaporous refrigerant from the evaporator means into the cavity of said housing means for forming and replenishing the pool of liquid refrigerant therein and with said second section being adapted to receive and convey vaporous refrigerant from the cavity of said housing means to said compressor means, said first portion of said second conduit means defining said means for expanding the expanded liquid refrigerant and comprising elongated capillary tubing means essentially entirely containable within the pool of liquid refrigerant and adapted to receive and convey therethrough the condensed liquid refrigerant from the condensing means for the expansion thereof within said capillary tubing means to said substantially lower pressure, said condensed liquid refrigerant in the elongated capillary tubing means being disposed in a heat exchange relationship with said mixture of liquid and vaporous refrigerant and primarily with the liquid refrigerant in said pool of liquid refrigerant for cooling the condensed liquid refrigerant to a temperature of at least about 25° F. less than said elevated temperature and for converting liquid refrigerant in said pool to vaporous refrigerant for conveyance thereof along with vaporous refrigerant from said mixture to said compressor means through said second section of the third conduit means.

2. A refrigeration system as claimed in claim 1, wherein the elongated capillary tubing means is defined by at least one capillary tube which has an internal diameter sufficiently small and is of a length sufficiently long to effect sufficient expansion of the liquid refrigerant to the pressure substantially lower than said elevated pressure for reception thereof in essentially liquid form in the evaporator means.

3. A refrigeration system as claimed in claim 2, wherein substantially the full length of said a least capillary one tube defining the elongated capillary tubing means is substantially in the form of a coil, and wherein all of the coil is containable in the pool of liquid refrigerant.

4. A refrigeration system as claimed in claim 2, wherein said at least one capillary tube defining the elongated capillary tubing means has first and second end regions, wherein a second portion of said second conduit means is connected to and extends between the first end region of said capillary tube and said condensing means, wherein a third portion of the second conduit means is connected to and extends between the second end region of the capillary tube and said evaporator means, and wherein said second and third portions of said second conduit means have an internal diameter substantially greater than that of said capillary tube.

5. A refrigeration system as claimed in claim 4, wherein said at least one capillary tube defining the elongated capillary tubing means is provided by a plurality of capillary tubes each having first and second end regions, wherein first manifold means connect the first end region of each of said plurality of capillary tubes to the second portion of the second conduit means, and wherein second manifold means connect the second end region of each of said plurality of capillary tubes to the third portion of the second conduit means.

6. A refrigeration system as claimed in claim 2, wherein said housing is vertically oriented with said cavity being defined by side wall means and upper and lower end wall means, wherein the pool of liquid refrigerant is containable in said cavity at a location spaced from the upper end wall means for defining a refrigerant vapor-containing volume within the cavity, and wherein the open ends of the first and second end sections of the third conduit means communicate with the vapor-containing volume within the cavity.

7. A refrigeration system as claimed in claim 6, wherein said second end section of the third conduit means has a length thereof containable within the pool of liquid refrigerant for cooling vaporous refrigerant received in said second end section and conveyed to the compressor means by said second section of third conduit means.

8. A method for operating a refrigeration system having refrigerant compressing means connected by first conduit means to refrigerant condensing means, and refrigerant evaporating means having cooling regions therein and connected to the condensing means by second conduit means and to the compressing means by third conduit means, comprising the steps of forming a portion of the second conduit means from capillary tube means, passing compressed refrigerant vapor at a pressure and temperature greater than ambient pressure and temperature from the compressing means into the condensing means for the condensation thereof into liquid refrigerant at substantially said pressure and temperature, passing liquid refrigerant discharged from the condensing means through the capillary tube means in a heat exchange relationship with a relatively cool mixture of liquid and vaporous refrigerant discharged from the evaporating means and primarily with liquid refrigerant in a pool of liquid refrigerant formed by liquid refrigerant from said mixture for vaporizing liquid refrigerant contained in said mixture and in said pool for simultaneously expanding and sub-cooling the liquid refrigerant in the capillary tube means to a pressure substantially lower than said pressure and to a temperature that is at least about 25° F. lower than the temperature of the liquid refrigerant discharged from the condensing means to provide for the introduction of the resulting expanded and sub-cooled liquid refrigerant into the evaporating means with essentially no additional expansion or evaporation thereof for over feeding of the evaporating means with liquid refrigerant and thereby effecting contact of essentially all cooling regions within the evaporating means with liquid refrigerant and to provide said mixture of liquid and vaporous refrigerant discharged from the evaporating means, and thereafter conveying vaporous refrigerant from said mixture and from the vaporization of the liquid refrigerant in said mixture and in said pool to the refrigerant compressing means for the compression thereof.

9. A method for operating a refrigeration system as claimed in claim 8, wherein essentially the entire expansion and sub-cooling of liquid refrigerant discharged from the condensing means are respectively provided by passing the liquid refrigerant through the capillary tube means and by immersing essentially the entire capillary tube means in the pool of liquid refrigerant.

10. A method for operating a refrigeration system as claimed in claim 8, wherein the temperature of the liquid refrigerant discharged from the condensing means is in the range of about 20° to 30° F. above ambient air temperature, and wherein the temperature of the sub-cooled liquid refrigerant of at least about 25° F. lower than the temperature of the liquid refrigerant discharged from the condensing means is at a temperature in the range of about 25° F. to 40° F.

11. A method for operating a refrigeration system as claimed in claim 8, wherein the expansion of the liquid refrigerant through the capillary tube means reduces the pressure of the sub-cooled liquid refrigerant to essentially the pressure of the vaporous refrigerant conveyed from the evaporating means to the compressing means.

12. A method for operating a refrigeration system as claimed in claim 11, wherein the capillary tube means is provided by at least one capillary tube of a diameter and of a length sufficient to effect said expansion of the liquid refrigerant, and including the additional step of confining a substantial portion of said at least one capillary tube in the pool of liquid refrigerant for effecting the primary sub-cooling of said liquid refrigerant.

13. A method for operating a refrigeration system as claimed in claim 12, including the additional step of maintaining the pool of liquid refrigerant from said mixture in said heat exchange relationship with substantially the full length of said at least one capillary tube during the operation of the refrigeration system.

14. A method for operating a refrigeration system as claimed in claim 13, wherein the at least one capillary tube is provided by a plurality of capillary tubes each of a diameter in said range, wherein the combined length of the plurality of capillary tubes corresponds to said length of the at least one capillary tube that is sufficient to effect said expansion of the liquid refrigerant.

15. A method for operating a refrigeration system as claimed in claim 8, wherein the over feeding of the evaporating means with liquid refrigerant provides a sufficient excess of liquid refrigerant through the evaporating means to provide the mixture with a sufficient volume of liquid refrigerant to form and maintain the pool of liquid refrigerant to primarily effect said sub-cooling of the liquid refrigerant discharged from the condensing means and passing through the capillary tube means.

16. A method for operating a refrigeration system as claimed in claim 8, wherein at least about 5 percent of said mixture discharged from the evaporating means is liquid refrigerant.

17. A method for operating an air conditioning system as claimed in claim 8, wherein the step of conveying the vaporous refrigerant to the compressing means includes the passing thereof in a heat exchange relationship with the pool of liquid refrigerant for effecting substantial saturation of the vaporous refrigerant.

* * * * *